United States Patent [19]

Compton

[11] Patent Number: 4,706,331

[45] Date of Patent: Nov. 17, 1987

[54] SECURITY HINGES AND JUNCTION BOXES FOR LAMP HOUSINGS

[75] Inventor: Wayne W. Compton, Chino Hills, Calif.

[73] Assignee: Kidde Consumer Durables Corporation, City of Industry, Calif.

[21] Appl. No.: 906,423

[22] Filed: Sep. 11, 1986

[51] Int. Cl.[4] ..... E05D 11/00

[52] U.S. Cl. ..... 16/223; 362/427; 403/97; 16/330; 16/340; 16/380

[58] Field of Search ..... 16/223, 340, 250, 330, 16/341, 344, 381, 380, 355; 403/97; 362/250, 269, 285, 371, 370, 427

[56] References Cited

U.S. PATENT DOCUMENTS 4,494,177 1/1985 Matthews ..... 362/427

*Primary Examiner*—Nicholas P. Godici
*Assistant Examiner*—G. M. Reid
*Attorney, Agent, or Firm*—Donald D. Mon

[57] ABSTRACT

The invention relates to a hinge for pivotally mounting flood lamps. The hinge includes a first and second knuckle. The first knuckle has an internally threaded socket. The second knuckle includes a first part and a second part, and the parts are interlocked for simultaneous rotation. The first part further has a rotation resisting surface facing the first knuckle. The hinge further includes a pair of shroud members, which each have counterbored aperatures therethrough and are arrange on each side of the second knuckle. There is a pair of threaded hinge pins, one each passing through a shourd member and a part of the second knuckle and threadably received in the first knuckles threaded socket. Loosening the threaded hinge pins permits relative rotation of the knuckles while tightening of the threaded hinge pins fixer the angular orientation of the hinge. The counterbores of the shrouds make difficult uninvited (i.e. vandalism) tampering of the hinge.

17 Claims, 6 Drawing Figures

SECURITY HINGES AND JUNCTION BOXES FOR LAMP HOUSINGS

FIELD OF THE INVENTION

This invention relates to hinges for mounting and for adjusting lamp housings such as housings for flood lights, with provisions to resist tampering, vandalism and theft and to a junction box useful with them.

BACKGROUND OF THE INVENTION

This invention relates to hinges for lamp housings, such as houisngs for flood lights. Lamps of the type of interest to this invention are generally provided to illuminate structures and areas. They are customarily mounted to a fixed base such as a mast or a stub shaft. Their field of illumination is intended to be adjusted, and for this purpose a hinge is provided. This hinge inables the lamp to be tilted to its most advantageous position.

However useful such a hinge may be for mounting and for adjusting the position of the housing, it generally constitutes the least secure part of the mounting system, and frequently also the most unattractive. Flood lights are increasingly used in architectual environments, not merely for illuminating structures and areas, but for illuminating them attractively and without themselves constituting an eyesore of their own. While much attention has been given to making the lamp housing attractive or at least unobtrusive, little has been done to improve the asethetics of their mounting means. Further, as the stub shafts and housing became more effective or at least less obtrusive, the hinges themselves became a more obvious target for tampering.

Thus, the inherent necessities of security and adjustability for a hinge have become even more demanding, not only as to security and convenience, but also as to asethetic appearance. It is not good practice to strengthen or to protect the hinge in such a way that it presents an attractive target to be overcome by the thief or the vandal. Instead, it is an object of this invention to provide a hinge and if desired also a junction box which is unobtrusive, which offers little visual challange (or stimulus) to the thief, which is readily adjusted and which is resistant to the types of tools that are most frequently carried by these undesirables. Therefore a visually attractive product becomes at once less obtrusive, more useful, and less of a target.

BRIEF DESCRIPTION OF THE INVENTION

A security hinge according to this invention is adapted to mount a lamp housing to a support (which support may be a junction box, if desired). It includes a first and second knuckle, the knuckles being hingedly joined by hinge pin means along an axis of relative rotation of the knuckles. The first knuckle includes rotation-resisting means. The second knuckle is formed as a pair of separable parts, one of which bears complementary rotation-resisting means. The hinge pin means draws the two parts toward one another, and against opposite sides of the first knuckle, thereby drawing the rotation-resisting means together releasably to prevent relative rotation of the knuckles. The parts are keyed together for mutual rotation. One of the knuckles is mounted to whatever is the mount and the other supports the housing.

The hinge pins means are brought to bear against the parts of the second knuckle through shroud members.

Each shroud member has a passage therethrough for the shank of respective hinge pin means, and a shoulder for the head of the hinge pin means. The shank is threadable into the first knuckle.

According to a preferred feature of this invention, the shroud members receive the head of the respective hinge pin means in such a way as to shield it from ready external gripping and preferably in such a way as to require the use of a tool which is commonly associated with socket type operations.

According to another preferred but optional feature of the invention, the external axial surface of the shroud members is circular so as to resist engagement by a gripping tool.

According to yet another preferred but optional feature of the invention, the rotation-resisting means comprises a plurality of interengaging protrusions and depressions, for example, radially extending or axially extending serrations.

According to yet another preferred but optional feature of the invention, one of the knuckles is attachable to a junction box, the junction box having an external circularly sectioned configuration resistant to gripping by a gripping tool.

The above and other features of this invention will be fully understood from the following detailed description and the accompanying drawings, in which:

DETAILED DESCRIPTION OF THE INVENTION

Figure 1:
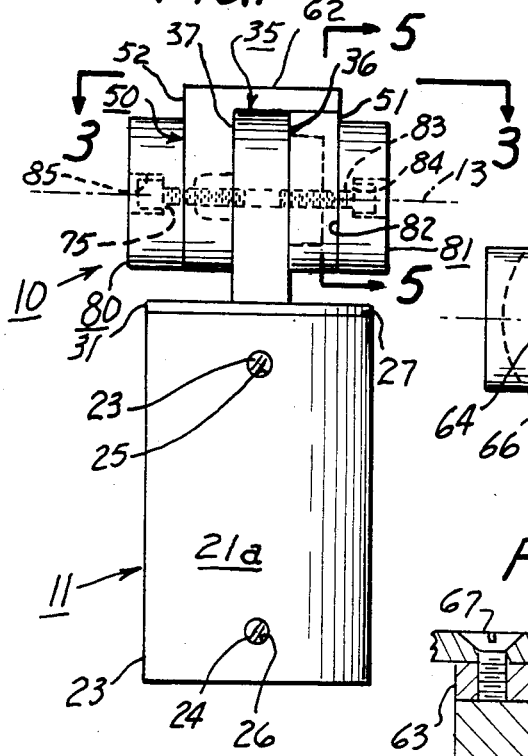
FIG. 1 is a side elevation of the presently preferred embodiment of the invention.
Figure 3:
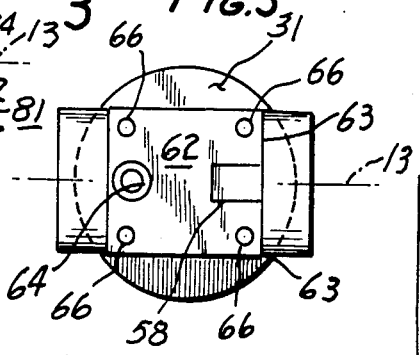
FIG. 3 is a top view taken at line 3—3 in FIG. 1.
Figure 2:
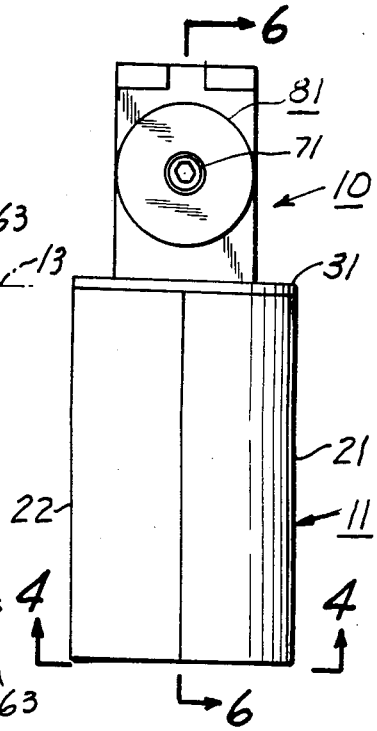
FIG. 2 is a right hand side view of FIG. 1.
Figure 5:
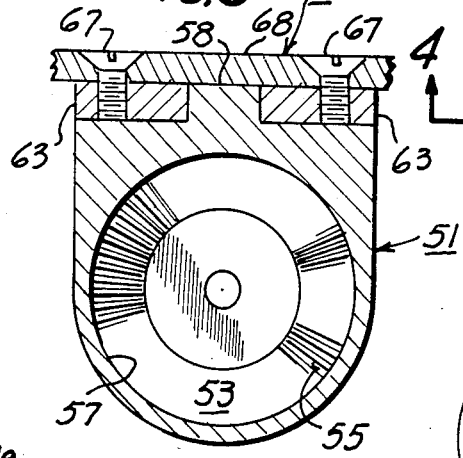
FIG. 5 is a cross-section taken at line 5—5 in FIG. 1.
Figure 4:
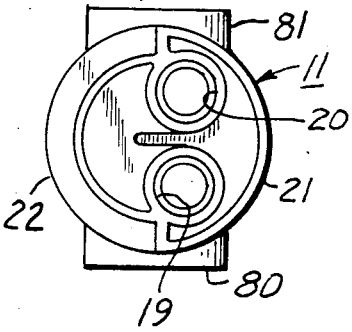
FIG. 4 is a bottom view of FIG. 1.
Figure 6:
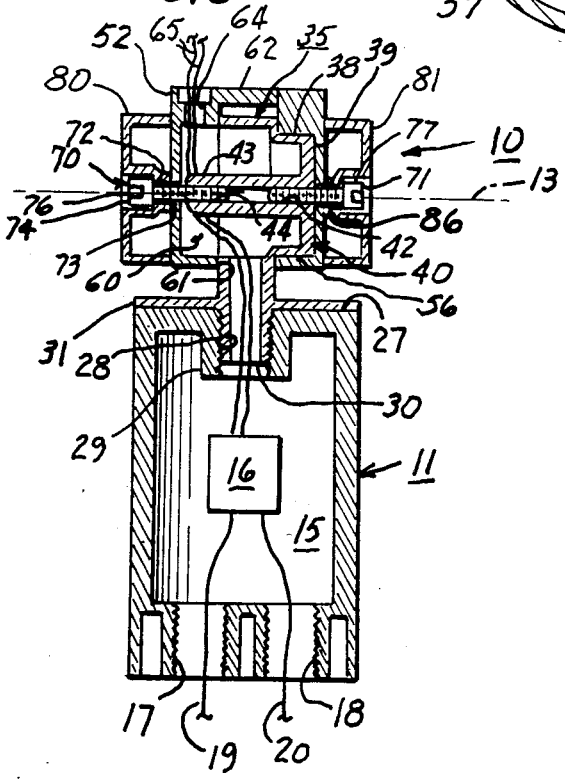
FIG. 6 is a cross-section taken at line 6—6 in FIG. 2.

The presently preferred embodiment of security hinge 10 is shown in FIG. 1 mounted to a junction box 11, and as shown in FIGS. 5 and 6 supporting a housing 12 for a flood lamp. The housing includes a central cavity 15 in which electrical devices 16 such as ballast means and the like can be housed. Ports 17, 18 pass electrical conduits 19, 20 to a mast in one desired arrangement. These ports may be internally threaded for mounting purposes and when both of them are threaded to a base they prevent independent rotation of the junction box. The box includes a circumferential wall 21*a* which is externally cylindrical and smooth so as to resist being gripped by a wrench or rotating means. It may conveniently be formed into two parts 21, 22 which may be joined together by screws or other means, for example by screws 23, 24 threaded through holes 25, 26 in one part into threaded receptacles (not shown) in the other. Removing screws 23 and 24 will permit one of the parts to be removed from the other to give access to the electrical connection and the like inside the junction box.

The upper end 27 of the junction box has a central threaded port 28 with an inwardly depending neck 29 to receive the 30 which depends from a base plate 31 of hinge 10. The base plate is smooth and makes a close, preferably fluid sealed, fit with the upper end of the junction box. Of course sealing means may be provided but will usually not be necessary. In any event, the nose of the hinge is threaded into the junction box so as to mount the hinge in its basic location.

The hinge includes a first knuckle 35 which rises from base plate 31. This knuckle has a first side 36 and a second side 37. From its first side 36 there projects a stub 38 in whose face 39 there is provided a series of rotation-resisting means 40, in this case a group of radially extending, axially facing serrations 41 spaced angularly apart around axis 13 of the hinge. An internal thread 42 is formed in a socket in stub 38.

From the second side there projects a stub shaft 43 with a socket having an internal thread 44.

A second knuckle 50 is provided as a first part 51 and a second part 52. First part 52 interengages with the first knuckle at the first aide of the first knuckle. This is a plate like object with a recess 53 adapted to slide and fit over stub 38 and has an internal face 54 with complementary rotation-resisting means 55 to engage with means 40. In this embodiment this means comprises a complementary set of serrations which match those on the first knuckle. It will be appreciated that these serrations are merely a single example of complementary means which interrupt the circularity of the body so as to prevent its rotation. It is equally possible to provide irregularities such as depressions and protrusions in other shapes and also to provide them if desired along the external wall 56 of stub 38 and the internal wall 57 of recess 53. However, the construction shown is readily molded and is to be preferred. A post 58 is provided on a top surface of the first part for a purpose which will become evident.

The second part 52 includes a recess 60 which ends at a face 61. A top plate 62 includes a pair of fingers 63 which straddle post 58 and with it form interlinking means which prevent the relative rotation of the two parts of the second knuckle. The second part has a port 64 to pass wires 65 from the junction box which wires have passed through the nose, through the recess in the first knuckle, and through the recess in the second part of the second knuckle so as to be available for the lamp whose housing is supported by the hinge. It will also be noted that four threaded holes 66 are provided in the top plate 61 to receive screws 67 threaded down through the housing wall 68 so as to be supported on the hinge.

In order to hold the knuckles together there are provided two hinge pins 70, 71. These are identical. They include a shank 72 with an external thread 73. They also includes a head 74 with a shoulder 75. According to the preferred embodiment of this invention the head includes at its outer end a wrenching recess 76 of the type commonly known as the "Allen head" recess. This is an internally hexagonal non-circular recess adapted to receive a hexagonal post-like wrench. Alternatively or also a group of external axial grooves 77 may be provided which could be engaged by an external socket wrench slipped axially over the head.

A pair of shroud members 80, 81 are provided at opposite sides of the knuckle. They are identical. They include a flat face 82, a central unthreaded bore 83 to pass the shank of the pin, and a shoulder 84 at the base of a counterbore 85. The shoulder of the counterbore is dimensioned so as to be abutted by the shoulder of the pin. The wall of the counterbore will generally leave a small annular spacing 86 for convenience. However, it need be no more than that required for easy rotation of the head within the bore, especially if only the internal wrenching recess is provided. If it is desired to give access to the outside of the head then the annular spacing will be large enough to permit the passage of a socket. Generally this will not be desirable and if there are any grooves, it may simply be enough to give a convenient grip for the user when he first threads the pin into the respective end of the knuckles. It will be observed that the shroud members, shroud and cover the head of the pins and these can be attacked only by the use of internal wrenching means which are not commonly carried by casual vandals or tamperers. Direct lateral access is prevented. Conveniently, the outside wall can be tapered further to frustrate engagement by a torque tool. The exterior surface of the shroud means is circular so as to frustrate the engagement by a external gripping means.

The installation of this device should be evident from the foregoing. The junction box and wiring are provided as shown and the knuckle is loosely assembled and the housing is attached to the second part of the second knuckle. Then the two hinge pins are tightened down, and just before the final tightening down of the assembly, the hinge is tilted to the desired angularity. Then both are tightened down. The device is now fully installed. The hinge has a smooth appearance and is not receptive to pliers, wrenches and the like which are commonly carried by vandals. Should the vandal somehow have gotten a purchase on one of the shroud members to the extent that it would be turned to loosen one of the hinge pins, still although the hinge may be somewhat loosened, the shroud member is loose from the hinge pin and further rotation of it will not loosen the hinge pin further. Therefore, even though the hinge might be somewhat loosened by such activity, it is highly unlikely that the vandal will succed in completely dismantling the hinge.

All parts as illustrated are readily manufactured by conventional casting procedures and there results an attractive and reliable security hinge. The hinge is useful without the junction box, but together with the junction box offers a very substantial advantage in architectual lighting installations.

This invention is not to be limited by the embodiment shown in the drawings and described in the description which is given by way of example and not of limitation, but only in accordance with the scope of the appended claims.

I claim:

1. A security hinge to mount a lamp housing to a support, said hinge comprising:

a first knuckle and a second knuckle joined together for relative rotation with respect to each other around a hinge axis;

said first knuckle having a first side and a second side through which said axis passes, an internally threaded axially-extending socket opening into each side, and including rotation-resisting means on said first side;

said second knuckle comprising a first part and a second part, said parts each including interlinking means for binding said parts for simultaneous rotation around said axis, said first part facing said first side and bearing complementary rotation-resisting means engagable with those on the first knuckle to restrain the knuckle against relative rotation when engaged to one another, said second part facing said second side, both of said parts having an axial hole therethrough;

a pair of shroud members each having an abutment face, a side face with an axial aperture extending between them, there being a counterbore extending into said aperture and an internal shoulder, one of said shrouded members being disposed on each side of said second knuckle; and a pair of hinge pins, each having an externally threaded shank and an enlarged head, and a shoulder on the head adjacent to the shank, said head having torque tool engagement means, and being so proportioned as to fit within said counterbore with the shoulders in abutment, the shank passing through the respective shroud member, second knuckle part, and into said socket, with the rotation-resisting means interengaged, and with the hinge tigthened together to hold it assembled and with a selected angularly adjusted relationship between the knuckles, said shroud members shielding said heads from direct lateral engagement by a torque tool.

2. A security hinge according to claim 1 in which said hinge pin head is internally recessed at its end to provide internal surfaces for torque tool engagement.

3. A security hinge according to claim 1 in which said hinge pin head is externally striated for torque engagement, there being only sufficient side clearance in the counterbore to pass an open socket.

4. A security hinge according claim 1 in which the exterior surface of the shroud members is circularly sectioned.

5. A security hinge according to claim 4 in which said exterior surface is tapered.

6. A security hinge according to claim 1 in which said interlinking means composes a tongue on one of said parts and a pair of fingers on the other, straddling the tongue.

7. A security hinge according to claim 1 in which said second knuckle provided with the means for attachment of a housing to it.

8. A security hinge according to claim 1 in which said knuckles are ported to pass electrical wiring through the hinge.

9. A security hinge according to claim 1 in which said rotation-resisting means comprises a plurality of complementary protrusions and depressions angularly apart around said axis.

10. A security hinge according to claim 9 in which said protrusions and depressions extend radially.

11. A security hinge according to claim 2 in which the exterior surface of the shroud members is circularly sectioned.

12. A security hinge according to claim 11 in which said interlinking means comprises a torque on one of said parts and a pair of fingers on the other, straddling the tongue.

13. A security hinge according to claim 12 in which said second knuckle is provided with means for attachment of a housing to it.

14. A security hinge according to claim 13 in which said knuckles are ported to pass electrical wiring through the hinge.

15. A security hinge according to claim 14 in which said rotation-resisting means comprises a plurality of complementary protrusions and depressions angularly apart around said axis.

16. In combination: a security hinge according to claim 1, and a junction box, said security hinge including a peripheral plate on the first knuckle and attachment means projecting below said plate, said junction box comprising a cylindrical split body having a pair of semi-cylindrical shells, which when assembled form an internal cavity to receive electrical circuit materials and end plates closing said cavity at each end, said end plates being ported to provide passage for electrical wiring.

17. A combination according to claim 16 in which one of said end plates is internally threaded, and in which said attachment means comprises an externally threaded nose threaded into said last-named part to attach the hinge to the junction box.

* * * * *